US005722192A

United States Patent [19]

Salley

[11] Patent Number: 5,722,192

[45] Date of Patent: Mar. 3, 1998

[54] MOVING DECORATIVE DISPLAY FOR ARTICLES OF CLOTHING

[76] Inventor: Sybil Salley, 30635 Lake Cir., Magnolia, Tex. 77355

[21] Appl. No.: 562,219

[22] Filed: Nov. 28, 1995

Related U.S. Application Data

[63] Continuation-in-part of Ser. No. 558,952, Nov. 13, 1995.

[51] Int. Cl.[6] ..... G09F 3/00

[52] U.S. Cl. ..... 40/329; 40/452; 40/586; 40/661; 362/106

[58] Field of Search ..... 40/329, 451, 452, 40/550, 553, 586, 660, 661, 665; 362/105, 106, 108, 251; 340/815.45, 815.53, 815.73

[56] References Cited

U.S. PATENT DOCUMENTS

| | | | |
|---|---|---|---|
| 1,328,823 | 1/1920 | De Sibour | 40/329 |
| 1,490,565 | 4/1924 | Hunter | 40/329 |
| 4,231,079 | 10/1980 | Heminover | 362/108 X |
| 4,574,269 | 3/1986 | Miller | 40/550 X |
| 4,602,191 | 7/1986 | Davila | 362/800 X |
| 4,709,307 | 11/1987 | Branom | 40/586 X |
| 5,323,554 | 6/1994 | MacDonald | 40/661 X |
| 5,343,445 | 8/1994 | Cherdak . | |
| 5,375,044 | 12/1994 | Guritz . | |
| 5,502,463 | 3/1996 | Sasaki et al. | 40/124 X |

FOREIGN PATENT DOCUMENTS

| | | |
|---|---|---|
| 4408951 | 9/1994 | Germany . |
| 9406890 | 12/1994 | Germany . |

*Primary Examiner*—Brian K. Green
*Attorney, Agent, or Firm*—Gunn & Associates, P.C.

[57] ABSTRACT

A mounted display is set forth comprising a central housing, a CPU within the housing along with a power supply and two memories. One memory stores an operating system while another memory, removable in form, stores a pattern to be displayed. A display strip provided with LCD or LED elements is powered to thereby provide illumination. A protective transparent tube and Velcro fasteners are used to secure the device on the person or user. The display is worn around the user as a belt or around a cap or hat. Another form comprises a jacket or vest mounted display for the back of the user.

16 Claims, 2 Drawing Sheets

PS
O.S.
CPU
MEM
MEM
M
N
OFF ON

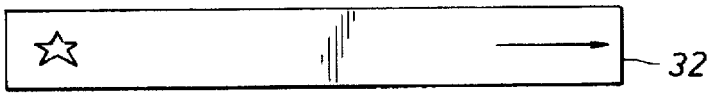
FIG. 6
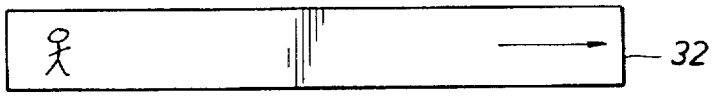
FIG. 7
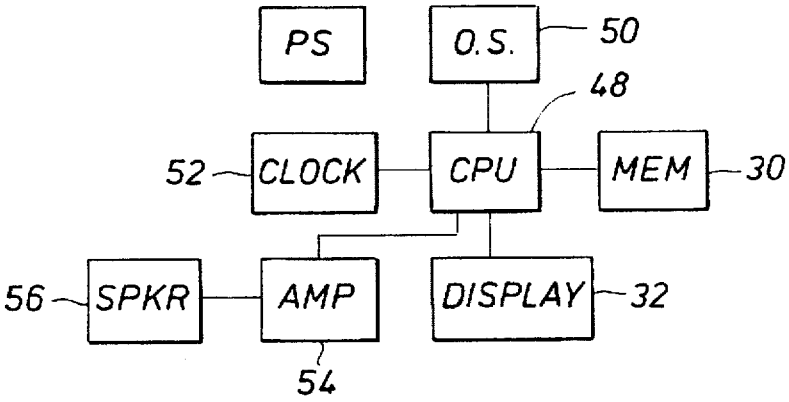
FIG. 8
FIG. 9
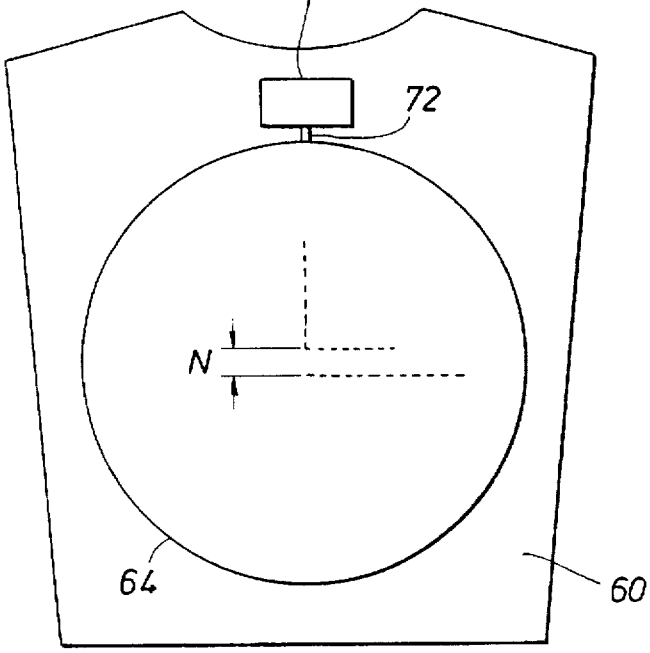
FIG. 10
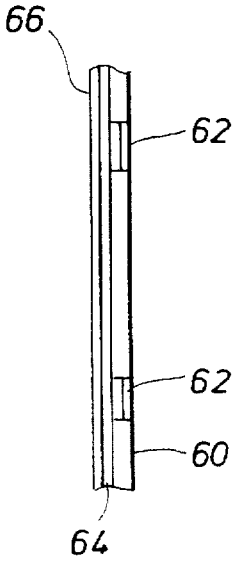
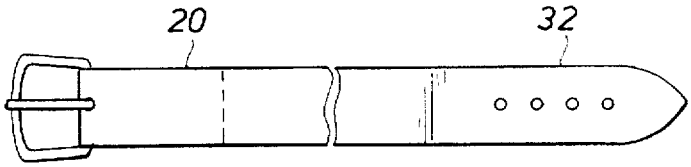
FIG. 11

MOVING DECORATIVE DISPLAY FOR ARTICLES OF CLOTHING

RELATED APPLICATION

This disclosure is a continuation in part of application Ser. No. 08/558,952 which was filed on Nov. 13, 1995, pending, and which sets forth a decorative display having moving imagery which is especially adapted for fitting on a pair of shoes. This particular display is especially adapted for attachment to articles of clothing.

BACKGROUND OF THE DISCLOSURE

In one aspect of the present disclosure, an endless loop is set forth which is specially suited for attachment on and incorporation in articles of clothing. More specifically, it finds application on a hat or belt. This enables an endless loop to be formed. It is especially useful in providing an endless loop display which can be seen from all directions when incorporated into a hat band. Consider a typical hat such as a hat with a brim extending outwardly from a crown. Another type hat is a cap, sometimes referred to as a baseball cap, in which the endless loop device of the present disclosure can be affixed to the cap just as well as it can be affixed and attached to the crown of a hat. In that location, it is highly visible. The visibility at the head of the person wearing the cap or hat provides a high degree of personal protection for those who are walking or are jogging at night. It can serve as an alarm to alert the public to the location and speed of the person wearing the hat. This is especially useful in warning automotive traffic of the person so that pedestrian accidents are avoided. It serves as a warning for the person wearing the device, and even serves as a warning whether they are jogging, walking, standing still, or riding a bicycle.

In addition to the encircling hat band, the device can be worn as a belt threaded through the belt loops of a typical pair of pants while worn by the user. That provides an alternate location enabling visual notice to the passing public.

In another aspect of the present disclosure, a large decorative display is suitably attached to the back of a jacket, shirt, coat or sleeveless vest. This provides a fixed area of large size which can support a moving display. In this particular instance, the display is large, ideally about 10 inches or greater in diameter when circular or a rectangle of about the same size. Within that sight area a protective visual display can also be formed. It can have the appearance of a blinking safety light, or perhaps can present a set of symbols indicative of a pedestrian in the dark. The large area display can be used to provide decorative and amusing visual graphics for the user. In the latter instance, the user is especially provided with a display which cycles through a desired routine so that the user is clearly identified. The large display can be chosen to accomplish some decorative or amusing pattern. Generally speaking, the only limit on the material displayed is interposed by the imagination of the user.

The device of the present disclosure is especially effective in providing a useful decorative system which adds a good deal of sparkle, charm and attractiveness for the wearer. Indeed, the displays that will be discussed permit changing of the displays including personalization. Better than that, the changes that are attached also provide customized displays which can serve as warnings to those on the road. It can serve as a safety warning for a younger child who may not be as careful as an adult in crossing the street or otherwise getting in the path of automotive traffic.

The present apparatus is also useful for a bicycle rider. The apparatus provides lateral and rearward illuminations that are especially useful so a bicycle rider is not so badly hidden in the absence of bicycle lights. Particularly on high performance bicycles, safety lights or other running gear are normally not readily available and usually are not incorporated. Such lights require a tire rotation generator and/or a battery system for operation. The present disclosure enables such lights to be added. Indeed, the lights which can be incorporated are substantially without limit, and can be any sort of envisioned decoration. If desired, the lights can provide a form of readable information or merely a warning. If such a warning is desired, the warning can be formed in the fashion of an irregular blinking system and the like. In the alternative, the warning can have the form of alternated black or blank regions; suffice it to say, the shape of the illuminated warning and the particulars of that warning can vary substantially. The present disclosure is an appendage to the clothing enabling the warnings to be provided whereby individualized memory chips can be loaded. The memory chips are included in a receptacle so they can be inserted or removed. Memory chips can be changed so the display is altogether different. Batteries are replaced in the same manner. The display wraps fully around the person or, more accurately, belt or hat of the user. The display can likewise extend only around a portion of the person. In either event, illumination is provided and the illumination is effective to serve as a safety warning, especially in the twilight hours. When placed on an active person such as a person walking or jogging or children at play, the personal activity draws significant attention to the person thereby providing an enhanced measure of safety. Even in twilight hours, the person wearing the device is much more noticeable. This is true of the belt type device or the large display.

One apparatus set forth in this disclosure has the form of an elongate band which closes and latches. The band is received within an elongate hollow protective tube of soft pliable plastic. The tube is relatively thin in wall construction and can be collapsed into a flat shape. The tube, when flattened, serves as a protective guard which prevents damage from water, damage from impact against a hard surface and the like. In particular, this enables the device of the present disclosure to be shielded from damage. The tube is attached with the intention of subsequent release and removal.

The apparatus of this disclosure is especially effective in providing a luminescent variable and a repetitively moving signal to serve as a safety or decorative warning. In fact, the disclosed apparatus can provide steady state, blinking or moving signals. Examples will be given of various patterns to show the full range of versatility and adaptability of the device.

SUMMARY OF THE INVENTION

Summarizing the present apparatus, it is a device having a flat, rectangular housing with a clasp or latch on one edge. The other edge supports an elongate strap member which is constructed of a series of LED or LCD devices capable of forming a visible image. Alternate forms include plasma lamps. The incremental points of light provided by the LED or LCD devices enables a set of numbers, letter, characters or the like to be located along the display. The display has a length such that it encircles the user and is attached to the hat, cap or belt of the user, and incorporates a plurality of points which can be illuminated. The points form a visible pattern. The strap terminates in the cooperative latch or clasp member so it can be hooked and formed into a circle. The display and the housing are inserted into a hollow transparent tubing member. The hollow tubing is a protector and when placed around the display, it is flattened into a relatively thin oval so that the equipment is fully protected from impact or water damage. The tubing supports a Velcro connector on one face which enables attachment to the hat or cap. The housing includes a receptacle which receives an inserted memory chip. The memory is preferably a ROM which holds or stores a program of selected size to provide the display illumination desired. The second form of display is a large circle or square for the coat of the user.

BRIEF DESCRIPTION OF THE DRAWINGS

So that the manner in which the above recited features, advantages and objects of the present invention are attained and can be understood in detail, more particular description of the invention, briefly summarized above, may be had by reference to embodiments thereof which are illustrated in the appended drawings.

FIGS. 6 and 7 both show different images where FIG. 2 shows alphanumeric representations while FIGS. 6 and 7 show different pattern displays;

FIG. 8 shows an alternate form of circuitry;

FIG. 9 shows an alternate form of display on a sleeveless vest;

FIG. 10 shows an attachment device for the vest supported display; and

FIG. 11 shows a belt display.

DETAILED DESCRIPTION OF THE PREFERRED EMBODIMENT

Figures 1, 2, 3, 4, 5:
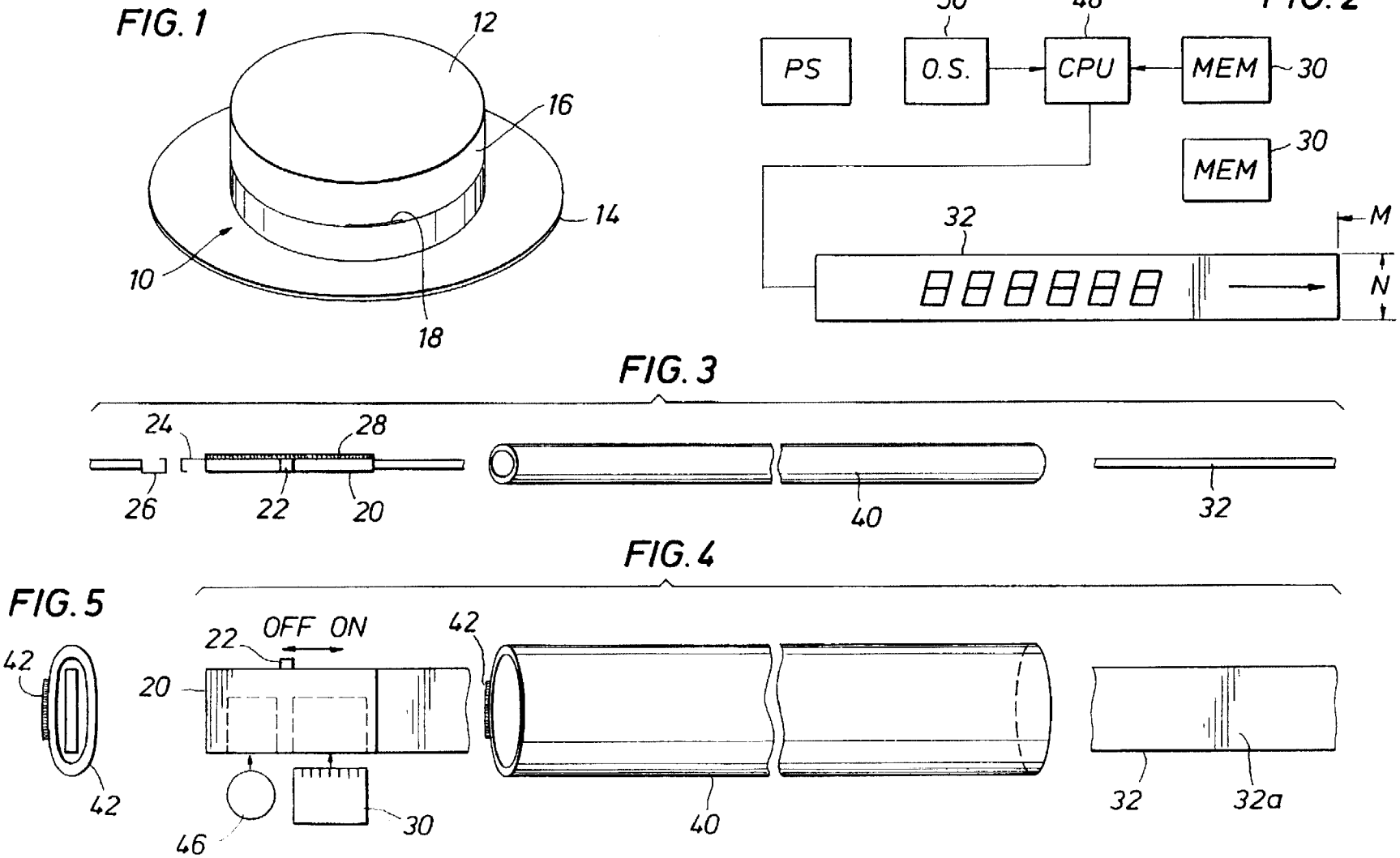
FIG. 1 is a perspective view of a hat which has been equipped with and is supportive of the present invention which fully encircles the hat of FIG. 1.
FIG. 2 is a schematic block diagram of the circuit components included in the housing which supports a CPU with an inserted memory device and which connects with the display as illustrated in FIG. 2 of the drawings.
FIG. 3 is a top edge view of the device of the present disclosure.
FIG. 4 is a view orthogonal to FIG. 3 showing the face of the device including the display which is inserted into a protective transparent tube.
FIG. 5 is an end view orthogonal to the side view of FIG. 4 showing how the tube is flattened to an oval around the display.

Attention is now directed to FIG. 1 of the drawings where the present invention is generally identified by the numeral 10. It is affixed around a hat, the hat being viewed from above. The hat 12 incorporates surrounding brim 14 and a central crown 16 thereby enabling a person wearing the hat to be sheltered from sum or rain when walking or running. The hat can be any typical material including water proofed material to enable rain to be excluded. This crown 16 provides a mounting surface to which is attached an attachment mechanism. One suitable attachment device is a Velcro strip 18 which is attached at several locations around the crown. The Velcro strip 18 is located so it holds the attached device 10 while the user walks or jogs, and secures the display device so it can be seen from the side and rear.

As shown in FIG. 1 of the drawings, the display device 10 has been slightly exaggerated in thickness to show how the present device loops completely around and is held on the hat crown. It is affixed with the Velcro at several locations. It is held above the brim so it will not slide upwardly or downwardly. The device 10 is cut to a length so it fits snuggly around the hat. If need be, the length can be extended or shortened in a fashion to be described. The physical construction of the device 10 will be made more apparent on the consideration of FIGS. 3, 4 and 5 which show mechanical aspects of the device 10.

Going now to the mechanical aspects, the housing 20 is shown in FIGS. 3 and 4 and is equipped with a small protruding toggle switch 22. The switch is moved between off and on positions. This switch provides electrical power for operation. The housing 20 incorporates all of the electronics. The housing 20 is attached to a clasp or hook 24 better shown in FIG. 3 which connects with a matching hook 26 on the opposite end of the display to be described. The hooks 24 and 26 have been omitted from FIG. 4 of the drawings; they are better shown in the edge view of FIG. 3. It is also noted that the housing 20 is constructed as a rectangle with two parallel edges. This rectangle is equipped with an attachment device on the back side. One suitable attachment device is a Velcro strip 28 which is shown on the back face suitable for contact against the hat to coact with the Velcro strip 18 previously mentioned. The strip 28 has been exaggerated in thickness to show one suitable location, and it is preferable to put it on the inside of the rectangular housing against the hat 12.

The rectangular housing holds the electronics for operation. The housing is constructed with an internal cavity and a plug in module 30 is sized to fit in the cavity. The module 30 stabs into the matched and mating receptacle and makes connection. The module 30 is a removable device which is a read only memory, sometimes known as a ROM. The ROM 30 stores the instructions for a specific pattern displayed as will be described. In the typical circumstances, the housing 20 is made to the height of about one inch. The height of the housing 20 is conveniently the same as the display. The display is an elongate strip structurally identified by the numeral 32. It preferably has a width approximately equal to that of the housing. It has a length sufficiently long to enable the strip display 32 to fully encircle the hat 12. It has a length to enable the hooks 24 and 26 to come together and fasten in the manner illustrated. More will be noted concerning adjustments in the length.

The strip is preferably flexible and formed of a set of light emitting elements in the strip. The strip is flexible so it is able to bend and wrap around the hat 12. In this aspect, the strip 32 thus comprises a flexible display. The display ideally extends the full length of the strip and goes fully around and provides illumination on all sides of the hat 12 shown in FIG. 1. More specifically, the strip 32 is shown in FIG. 3 of the drawings connecting with the hook 26 which matches and connects to the hook 24. The two hooks 24 and 26 reach over and clasp, thereby securing the strip tightly. This tight arrangement of the strip around the hat enables the owner to install the strip snuggly so it holds around the hat 12. More importantly, the strip is a visible display having a side which provides illumination in a manner to be explained. The strip has a height which matches the housing 20 as mentioned. In turn, the strip fits within a soft plastic protective tube. FIG. 3 of the drawings shows the tube 40 axially aligned and provided with sufficient length that it encircles the hat crown, and the ends of the tube are located almost completely encircling the installed display strip 32. The tube can be manufactured in a round shape but is preferably flattened somewhat at installation. A soft transparent clear plastic is used. The wall thickness is sufficient to provide shock protection for the strip. The tube 40 as shown in FIG. 4 of the drawings shows another aspect of the same tube, it being noted the tube is flattened into an oval shape in the respective views. The tube has sufficient length to completely enclose the display strip as mentioned and to abut ends across the housing 20. Along one side, the tube is provided with Velcro in patches at 42. The Velcro is included to fasten the display strip 32. The cooperating and mating material for the Velcro connection is installed at selected locations 18 as illustrated in FIG. 1. This installation requires the patches of Velcro along the tube to match the locations 18.

The housing 20 can have a length of about two inches. Including the latch 24 at one end, the housing is the only blank spot, visually speaking, in the presentation to the exterior around the hat 12. At the time of installation, the strip 32 is positioned in the tube 40 and the tube is then attached by using the Velcro patches. The Velcro patch 42 is jammed up against the Velcro patches 18 to make proper connection. This is accomplished with the display strip 32 on the interior. FIG. 5 shows how the tube 40 is flattened in operation. Latching occurs by pulling the strip 32 snug so the two hooks 24 and 26 are appropriately engaged. The switch 22 can be operated at that time. Ideally, the protective tube 40 shields practically all the equipment and the two ends of the tube are juxtapositioned adjacent to the switch 22 so there is very little unprotected area. Even the two ends of the tube, if positioned over the housing 20, provide a measure of physical protection and exclusion of water. To take advantage of the protective nature of the housing, the ROM 30 is inserted from the bottom and thus is less likely exposed to unintended water or moisture in that area. If required, the tube 40 can be made slightly long and can be bunched by telescoping movement of the tubing 40 with respect to the display strip 32. Because the tube is formed of relatively pliable material, it can be pushed back somewhat, thereby exposing the hooks for connection or disconnection.

Attention is now directed to FIG. 2 of the drawings. It shows the electronic components which are secured in the housing 20. There is a CPU 48 which is provided with a fixed memory which is identified at 50. The memory 50 holds the CPU operating system and is therefore labeled as the OS memory. By contrast, a removable and differently programmed memory can be input with the memory chip 30 shown in FIG. 2. Two or three such chips can be provided with different programs. In fact, the variety can be widely extended. Basically, the only limitation on the memory chip 30 is the artistic liberties permitted to the display strip 32 shown in FIG. 2. Display strip 32 is shown with a number of numeric signals displayed which proceed from one end to the other. Indexing and displaying of a set of numbers, letters or a mix thereof along the strip can be accomplished. The strip is provided with a fixed number of alphanumeric stations. For instance, it can be provided with ten, twenty, fifty or one hundred alphanumeric stations. In part, this can be accomplished through the use of LED or LCD displays. One of average skill in the art can readily provide five by seven numeric displays to pick a particular example. If required, the number of light emitting points in each station can be increased depending on the detail and gradation desired for the strip.

In an alphanumeric mode, the strip is provided with a specified number of stations represented by the whole number integer K where K is some number typically between about ten and one hundred. In an alternative aspect, the entire strip can be used as a writing surface provided with light emitting points or elements, these being deployed in a rectangular pattern which is described by the dimensions of M by N where M and N are both whole number integers. For instance, the height of the strip might be twenty five units and the length of the strip might be five hundred units. In that sense, the strip can then function to provide alphanumeric symbols as shown in FIG. 2 of the drawings, or alternately, it may be used to provide various graphics as shown in FIG. 6 or human representations as shown in FIG. 7. Without regard to the particular programmed information input to the strips shown in FIGS. 2, 6 and 7, the data is displayed on the strip. The data can be displayed in a fixed mode, i.e., it does not move along the strip, or it can be displayed in a moving mode in which symbols proceed from left to right as viewed in the drawings. In the latter sense, the strip 32 is a graphic representation of a ticker tape to pick one example. Since the example can be widely extended, one will appreciate how the imagination of the user can be implemented in many ways.

The strip 32 is supportive of the LCD or LED elements. The strip is constructed with the LED and LCD elements which are deployed in the rectangular pattern. As noted, the strip can be formed with K symbols to provide strictly an alphanumeric protocol, or the strip can be formed in the M by N light forming pattern under control of the program stored in the memory.

In one aspect of the present disclosure, the strip is constructed so the strip can bend. Again, the light emitting elements which are LCD or LED elements are relatively small and embedded in the strip. The strip thus is comprised of an elongate flexible member which enables the strip to extend around the hat.

In operation, the strip 32 along with the housing 20 are installed in the following manner. The Velcro material is attached to the hat 12 at the appropriate height at several locations around the crown. Representative locations are shown in FIG. 1 of the drawings. Ideally, about four to six locations of attachment will more than adequately hold the display device on the hat. The strip 32 is threaded through the tubing 40. This requires that the tubing 40 be flattened somewhat. The strip is then positioned around the hat so the hat crown is encircled and the hooks 24 and 26 are pulled together and latched. In this step of installation, it may be necessary to push apart the two ends of the tubing 40. If the tubing is excessively long, it can be trimmed slightly. Furthermore, the strip can be installed with the switch 22 off or with no memory chip 30. The user can then select one of several memory chips 30 which are then inserted into the housing 20. The switch 22 can then be operated at a convenient time. Of course, when the switch is operated, this applies electrical power from the power supply to the CPU 48 and provides power for operation of the CPU and the light emitting elements in the display strip 32. The power supply is identified in FIG. 2 at the symbol PS, and may require a removable and replaceable battery 46 as shown in FIG. 4. In that view, a battery is placed in a suitable housing cavity and electrically connected in the circuit.

The foregoing utilizes the strip to provide illumination fully around the hat. In an alternate aspect, the remote right hand end of the strip can be simply a plastic belt identified in the region **32*a* at the right hand end of FIG. 4. In that event, the strip region is dark meaning it has no lights to provide any light or reflective aspect. In this region, the strip can be left dark which provides a length of material which can be trimmed or lengthened to accommodate different sized hats. Note should be taken of the different dimensions of strip 32. The strip 32** is the portion of the apparatus which varies in length to accommodate different hat sizes. This length can readily be provided simply by extending the display components in the strip. If required, the end portion 32*a* can be blank. In that instance, the strip is a belting of bendable plastic sheet about one to one and one fourth inches in height and having a thickness of perhaps one fourth inch or less. In any event, the strip is fabricated initially to that length and the hook 26 is attached to the distal end of the strip. This attachment of the strip to the hook 26 at one end and the housing 20 at the other end enables the continuous band-like member to be installed. In like fashion, the tubing 40 can be cut to the precise length or it can be excessively long. The tubing can be easily trimmed by the owner using a knife to cut away excess portions of the tubing. The tubing is preferably provided with the Velcro material as mentioned so connection on the hat can be made.

In FIG. 8 of the drawings, a modified version of the electronics included in the housing 20 is illustrated. As before, there is a CPU 48 which operates in conjunction with a ROM 30. Again, the operating system is provided from the memory 50. The display 32 is again included as before. To enhance the attractiveness and youthfulness of the device, it is provided with a system clock 52 which will be discussed in conjunction with the enhanced audio system. The CPU connects to an output amplifier 54, and a loud speaker 56 is connected to that to thereby convert the output audio into a sufficiently loud signal that it can heard.

In this instance, the ROM is divided into two components, one storing memory instructions for the visible display on the strip 32. That is provided without alteration. Emphasis should be placed on the clock 52. The clock is used to control the rate at which the symbols advance along the strip 32. They can travel fast or slow and this is subject to clock control. The ROM also stores audio which is input to the CPU 48, and then provided to the amplifier. One approach is to simply sample a short piece in music and loop the music so that it is repeated indefinitely. Such a looping approach enables the operator or user to repetitively play a two or three minute musical accompaniment or other interlude. The speed of the music is determined by the clock speed. Obviously, if the clock is speeded up, the music will be played more rapidly. This will change the frequency of the music if desired. Rather than music, it is also possible to store sound which is synchronized with the symbols. This can be a type of sound effect which is an accompaniment to the symbols shown on the display strip. The accompaniment is timed or synchronized audio can be keyed to the symbols on the display strip 32. As an easy example, assume simply that the display strip is flashed on and off with a blinking star, or perhaps fifteen stars along the strip. Assume that they blink once every three seconds for a short interval such as 0.1 seconds. Indeed, they can be shorter, having the appearance of a strobe light. A crescendo of sound keyed to that sequence can be provided in this approach. Moreover, the symbols provided on the display strip 32 can be looped (meaning that they are repeated without limitation so long as the system is turned on) and the audio accompanying that can likewise be looped, meaning that the audio continues until operation is ended. In summary, the audio is ideally keyed to the visual effects. Both audio and visual effects can be provided in a single frame or continuous moving images (not terribly different from very early movies) taking advantage of jerky motion or smoothing it as desired.

FIG. 11 shows a belt to be worn around the waist. It has any suitable belt buckle or clasp with one form being the illustrated buckle. The belt is preferably sized to fit most adults, being about 32" to 44" in length.

Attention is now directed to FIGS. 9 and 10 of the drawings which show an alternate form of the device. The device is in FIG. 9 which is mounted on a sleeveless vest 60. The vest 60 has a back region which accommodates the device and it is shown in the form of a circle although it can certainly be rectangular in shape. The device shown in FIG. 9 is provided with a number of display points, i.e., LED or LCD devices installed in a pattern which is again sized by the symbols M and N where M and N are whole number integers and describe the number of light components. In this particular instance, M and N are large and can easily be in excess of 100. This depends in part on the spacing between adjacent lamps applying that term generally to the LED or LCD devices. In any event, they are arranged in the M by N pattern as mentioned heretofore with regard to FIG. 2 of the drawings. This is been indicated symbolically in FIG. 9. Suffice to say, the display is more generous in that M and N can be large and equal, providing a rectangular or square area. Assume for purposes of discussion that there is a spread of 200 by 200 lamps. In this particular instance, if the display area is 200 by 200, a greater variety of symbols can be presented.

Going on with the description with FIG. 9, the present disclosure thus forms a circular display 64. It is preferably formed of a sheet of flexible or elastic mounting materials. The sheet of materials is constructed and arranged so that it is slightly flexible. It is attached to the vest 60 again using Velcro strips 62 which are shown in FIG. 10 of the drawings. The Velcro strips 62 serve as mounting patches. The electronics shown in FIG. 2 of the drawings are mounted in a housing 70 which is shown in FIG. 9. The housing 70 is connected by suitable electrical conductors 72 which extend to the display. In this particular instance, rather than denote the display as a strip (shown in FIG. 2), in this embodiment, the display will be denoted as a large screen display, hereinafter LSD. It is formed of the same type of LED or LCD elements deployed in the M by N rectangular pattern. Indeed, the pattern can be rectangular, or it can be a circular distribution of points in a circle having M lights across the circle. It still is a set of LED or LCD light elements in a regular pattern with even spacing between adjacent elements. In either case, this provides a greater sense of detail and variety in the symbols represented. The housing 70 provides the circuitry as shown in FIG. 2 of the drawings. It encloses the alternate ROM memory chips 30 and supports the CPU 48 and the associated equipment. As before, a replaceable battery 46 is electrically connected in the housing 70 as shown in FIG. 5 of the drawings.

As will be understood, the vest 60 shown in FIG. 9 can be a safety vest so that a jogger at night can be easily seen. This especially enables the jogger to run along the streets and be visible because the pattern of illumination provided from the LSD serves as a warning signal to those approaching from the rear. It is assumed that the runner or jogger can see approaching traffic and will take necessary precautionary actions to avoid being struck by automobile traffic. The vest 60 was described as sleeveless but it will be understood that it can just as readily by a jacket or coat formed of any suitable material. Typically, a lightweight windbreaker is especially desirable for jogging in inclement weather. In like fashion, the hat 12 can be a cap having a bill rather than a full brim extending around the crown. In either instance, variations in the clothing can be accommodated in this fashion. With regard to size, the length of the device 10 enhances the lengths of the display strip can be varied. As a generalization, the length is substantially shorter when installed on the brim of the hat 12. It is somewhat longer when used around the waist of the person. For that, attachment to the person can easily be accomplished by using the belt loops of a pair of trousers or pants for the user. At an alternate aspect, the strip can simply function as an belt and is fastened around the user and is held in position by the clasp mechanism shown in FIG. 3 of the drawings.

If desired as a belt, the Velcro fastener can then be omitted and the device is then held on the user by belt loops or simply by tensioning around the waist of a person.

While the foregoing is directed to the preferred embodiment, the scope thereof is determined by the claims which follow:

What is claimed is:

1. A visible, decorative, repetitive, body supported display attached to clothing and providing an illuminated image, the display comprising:

(a) a housing enclosing a memory wherein the memory stores a set of data for providing a visible image;

(b) a CPU provided with the set of data from the memory so the CPU provides signals forming a specified visible image:

(c) an illuminated display having an illuminated and controlled operative state provided with the signals from the CPU wherein the display comprises an elongate display strip and the display extends substantially along said strip; and (d) a connector for attaching said display to be worn encircling a person, wherein (i) said display further includes a protective surrounding transparent bendable plastic tube about said display strip, and (ii) said tube is sufficiently soft to be flattened into an oval shape when installed and said tube is provided with hook and loop material for attachment to a hat worn on said person.

2. The display of claim 1 wherein said display has the form of an elongate display providing a set of alphanumeric symbols.

3. The display of claim 1 wherein said memory is a read only memory inserted into a housing and removable therefrom to enable changing for another read only memory.

4. The display of claim 1 wherein said housing encloses a power supply, said CPU, a CPU connected to a second memory holding an operating system, and said memory is a removable memory for a desired visual display pattern.

5. The display of claim 1 wherein said display has M by N lighted points and said CPU forms signals to operate said M by N points to form images stored in said memory and M and N are whole number positive integers.

6. The display of claim 7 wherein said CPU advances the display images along said display.

7. The display of claim 5 wherein said illuminated display provides light determined images, and said memory stores an audio signal to accompany said light determined images, and said CPU provides said stored audio signal to an audio output device.

8. The display of claim 1 wherein said display is an elongated rectangular strip protected at an exposed face by said tube.

9. The display of claim 1 wherein said CPU is deployed in said housing and said housing has a rectangular shape and said housing and said elongate display strip comprises a continuous lengthwise structure.

10. The display of claim 9 wherein said strip has two ends and said ends connect into a loop enclosed in said tube.

11. The display of claim 10 wherein said two ends connect at a pair of mating strip end connectors.

12. The display of claim 10 wherein said end connectors are hooks.

13. The display of claim 1 further comprising;

(a) a clock operatively connected with said CPU to prompt said CPU to form a set of said visual images repetitively;

(b) wherein said memory stores the visual images to be formed by the CPU therein; and (c) wherein said visual images are progressively formed over a period of time along said elongate display strip so that said visual images form thereby are incrementally moved along said strip.

14. The display of claim 13 wherein said strip has M by N lighted points and said CPU forms signals to operate said M by N points to form images from said memory and wherein M and N are whole number positive energies.

15. The display of claim 13 wherein said display provides alphanumeric symbols.

16. The display of claim 15 wherein said memory comprises a removable read only memory storing a set of said alphanumeric symbols.

* * * * *